US005779521A

United States Patent [19]

Muroyama et al.

[11] Patent Number: 5,779,521

[45] Date of Patent: Jul. 14, 1998

[54] METHOD AND APPARATUS FOR CHEMICAL/MECHANICAL POLISHING

[75] Inventors: Masakazu Muroyama, Kanagawa; Masayoshi Sasaki, Tokyo, both of Japan

[73] Assignee: Sony Corporation, Tokyo, Japan

[21] Appl. No.: 607,558

[22] Filed: Feb. 27, 1996

[30] Foreign Application Priority Data

Mar. 3, 1995 [JP] Japan ..... 7-044065

[51] Int. Cl.[6] ..... B24B 1/00

[52] U.S. Cl. ..... 451/56; 451/287; 451/288

[58] Field of Search ..... 451/56, 285, 286, 451/287, 288, 289, 443

[56] References Cited

U.S. PATENT DOCUMENTS

| | | | |
|---|---|---|---|
| 5,032,203 | 7/1991 | Doy et al. | 451/287 |
| 5,081,051 | 1/1992 | Mattingly et al. | 451/56 |
| 5,216,843 | 6/1993 | Breivogel et al. | 451/285 |
| 5,421,768 | 6/1995 | Fujiwara et al. | 451/285 |
| 5,433,650 | 7/1995 | Winebarger | 451/287 |
| 5,456,627 | 10/1995 | Jackson et al. | 451/56 |
| 5,516,327 | 5/1996 | Kawasaki | 451/285 |
| 5,536,202 | 7/1996 | Appel et al. | 451/285 |
| 5,547,417 | 8/1996 | Breivogel et al. | 451/443 |

FOREIGN PATENT DOCUMENTS 149158 9/1982 Japan .

*Primary Examiner*—Timothy V. Eley
*Assistant Examiner*—Derris H. Banks
*Attorney, Agent, or Firm*—Hill & Simpson

[57] ABSTRACT

A polishing method and apparatus applied for planarizing a substrate presenting surface step differences in a production process for a substrate of a semiconductor device. The substrate is ground by being brought into sliding contact with a polishing cloth applied taut on a rotary table as a polishing agent is supplied to the polishing cloth. The grinding for the substrate is carried out until partway under a first condition in which the polishing cloth is ground under a pre-set condition by being slidingly contacted with grinding abrasive grains of the rotary grinding head so that surface roughness of the polishing cloth is maintained at a substantially constant value equal to the surface roughness value prevailing prior to start of grinding. The residual portion of the polishing is carried out under a second condition in which the surface roughness of the polishing cloth is gradually lowered by terminating the grinding. Polishing with superior planarity may be achieved in a shorter time.

6 Claims, 8 Drawing Sheets

METHOD AND APPARATUS FOR CHEMICAL/MECHANICAL POLISHING

BACKGROUND OF THE INVENTION

1. Field of the Invention

This invention relates to a polishing method and, more particularly, to a polishing method applied to a production process for a semiconductor apparatus for planarizing a substrate presenting surface step differences. The invention also relates to an apparatus for carrying out the polishing method.

2. Description of the Related Art

The recent tendency in the field of semiconductor devices is towards a larger device capacity. Thus the technique for multi-layer interconnection has become crucial for achieving the increased device capacity. With the multi-layer interconnection technique, it is necessary to planarize the underlying layer because a step difference is produced due to micro-irregularities on the underlying layer and hence the interconnection tends to be ruptured on the site of level differences.

For planarizing a wafer, a method of removing any protrusions on the step difference by chemical/mechanical polishing (CMP) is employed.

For carrying out CMP, a polishing apparatus shown in a side view of FIG. 1 is employed. The polishing apparatus is mainly comprised of a rotary table 2, having a polishing cloth 1 extended taut thereon, means for supplying a polishing agent 3 to the polishing cloth 1 and a substrate holder 5 for tightly ding a wafer (substrate) thereon.

The rotary table 2 may be rotated in a direction shown by arrow A in FIG. 1 by having its center shaft 2*a* coupled to an output shaft of an electric motor, not shown.

The substrate holder 5 has its center shaft 5S connected to a driving mechanism, not shown, so as to be rotated in a direction shown by arrow D. The substrate 4 may be brought into and out of sliding contact with the polishing cloth 1.

For polishing by the above-described polishing apparatus, the substrate 4 is rotated while it is held by the substrate holder 5. As the rotary table 2 is rotated, the polishing agent 3 is supplied from the polishing agent supplying means 6 onto the polishing cloth 1. The surface of the substrate 4 to be polished is brought into sliding contact with the polishing cloth 1 with the interposition of the polishing agent 3 for polishing the substrate 4.

Since the substrate 4 is rotated about its own axis by rotation of the substrate holder 5 and also about the center of the rotary table 2 by rotation of the rotary table 2, the trajectory of a given point on the surface of the substrate 4 to be polished is a combination of the two sorts of rotations, thus achieving highly uniform polishing.

Meanwhile, the polishing cloth 1 is formed of a flexible material, such as polyurethane, having its surface controlled to a pre-set roughness, for possible avoiding damages to the substrate.

Such polishing cloth is resiliently deformed under the thrusting pressure of the substrate holder 5, so as to follow the shape of the substrate 4 presenting differences in thickness or inundations. However, a problem is raised that the polishing cloth enters not only the protrusions of the step differences to be removed but also into the recesses adjacent to the protrusions.

In particular, if the polishing cloth 1 has a highly fluffy surface, an increased polishing speed may be achieved because a large quantity of the polishing agent may thereby be retained. However, the wafer cannot be planarized sufficiently since the recesses of the step differences tend to be polished and hence the deference in the polishing speed cannot be maintained between the recesses and the protrusion of the step differences.

If the polishing cloth 1 has a less fluffy surface is employed for decreasing surface roughness, the polishing speed is significantly lowered, even although the differential polishing seed may be maintained between the protrusions and the recesses of the step differences and hence the polishing with improved planarity may be achieved.

However, since the polishing cloth 1 is worn out during polishing, the above-described polishing characteristics, such as the polishing speed or the planarity in polishing, undergo changes with lapse of time.

OBJECTS AND SUMMARY OF THE INVENTION

It is therefore a principal object of the present invention to provide a polishing method for achieving polishing with improved planarity in polishing by controlling surface roughness of the polishing cloth for conforming to suitable conditions without lowering the polishing speed.

It is another object of the present invention to provide an apparatus for controlling surface roughness of the polishing cloth.

The first polishing method for polishing a substrate by bringing a surface of said substrate to be polished into sliding contact with a polishing cloth extended taut on a rotary table as a polishing agent is supplied to said polishing cloth, according to the present invention, includes partially carrying out the polishing under a first condition in which the surface roughness of the polishing cloth is maintained to be substantially equal to surface roughness prevailing before start of polishing, and subsequently carrying out the remaining portion of the polishing in continuation to the polishing under the first condition under a second condition in which the surface roughness is decreased gradually.

The first condition is generated by carrying out the grinding for the polishing cloth under the pre-set condition simultaneously as the polishing, while the second condition is generated by terminating the grinding.

For carrying out similar polishing for the next substrate, the surface roughness of the polishing cloth needs to be restored to a value approximately equal to a surface roughness value prevailing before start of polishing. Thus it is preferred that the grinding under the pre-set condition be carried out for the polishing cloth having gradually decreased surface roughness after the polishing comes to a close and the substrate is separated from the polishing cloth.

The second polishing method for polishing a substrate by bringing a surface of the substrate to be polished into sliding contact with a polishing cloth extended taut on a rotary table as a polishing agent is supplied to the polishing cloth, according to the present invention, includes carrying out the polishing until partway under a first condition in which the surface roughness of the polishing cloth is maintained at a constant larger value, and subsequently carrying out the remaining portion of the polishing in continuation to the polishing under the first condition under a second condition in which the surface roughness is maintained at a smaller constant value.

The first condition is generated by carrying out the grinding under pre-set conditions for the polishing cloth applied taut on a rotary table and the second condition is generated by carrying out the grinding under different conditions for a different polishing cloth applied taut on a separate rotary table. Alternatively, the first condition is generated by carrying out the grinding at a pre-set location for a polishing cloth applied taut on a sole rotary plate, and the second condition is generated by carrying out the grinding under different conditions at another pre-set location for the same polishing cloth.

The grinding for the polishing cloth is carried out by bringing a rotary grinding head into sliding contact with the polishing cloth as a surface of the rotary grinding head carrying grinding abrasive grains is rotated, while the grinding under the different conditions is carried out using at least one of the thrusting pressure and number of revolutions of the rotary grinding head and the grain diameter and hardness of the grinding abrasive grains which is lower than that for the grinding under the pre-set conditions.

The first polishing method of the present invention may be carried out by a polishing apparatus having each one substrate holder and a rotary grinding head for a sole rotary table on which a polishing cloth is applied taut. That is, the first polishing method may be carried out by modifying the method for using the conventional polishing apparatus.

The following two polishing apparatus may be envisaged as a polishing apparatus for carrying out the first polishing method of the present invention.

The first polishing apparatus includes two or more rotary tables on each of which a polishing cloth is applied taut, means for supplying a polishing agent to each polishing cloth, a rotary grinding head arranged for each rotary table for facing each polishing cloth, a substrate holder adapted for tightly holding a substrate and for bringing the substrate into sliding contact with each polishing cloth as the substrate is rotated, and movement means for moving the substrate between the rotary tables. The rotary grinding head grinds each polishing cloth for according different surface roughnesses to the polishing cloths by bringing its surface carrying grinding abrasive grains into sliding contact with each polishing cloth as the surface of the head carrying the grinding abrasive grains is rotated.

The second polishing apparatus according to the present invention includes a sole rotary table on which a polishing cloth is applied taut, means for supplying a polishing agent to the polishing cloth, a plurality of rotary grinding heads arranged at two or more pre-set locations facing the polishing cloth, a substrate holder adapted for tightly holding a substrate and for bringing the substrate into sliding contact with the polishing cloth as the substrate is rotated, and movement means for moving the substrate between the downstream side regions. Each rotary grinding head has a surface carrying grinding abrasive grains which is rotated and brought into sliding contact with the polishing cloth for carrying out grinding of the polishing cloth for according different surface roughnesses to the polishing cloth in downstream side regions thereof with respect to the preset locations.

In any of the above polishing apparatus, for according different surface roughnesses to the polishing cloth(s), the rotary grinding heads are preferably controlled so as to have different thrusting pressures and/or different rpms. The hardness and/or grain diameter of the grinding abrasive grains in the rotary grinding heads are also preferably different for the two or more rotary grinding heads.

If, in the application of the polishing method of the present invention, the substrate is polished until partway under the first condition in which the surface roughness of the polishing cloth is maintained at substantially the equal value to the surface roughness prevailing before start of polishing, or in which surface roughness is maintained at a larger relative value, substrate surface planarity may be achieved to a certain extent within a shorter time. If then the substrate is polished under the second condition in which surface roughness of the polishing cloth is decreased gradually, or in which surface roughness is maintained at a smaller constant value, substrate surface planarity may be improved further.

With the polishing apparatus of the present invention, since different values of surface roughness may be accorded to the different polishing cloths or different regions of the same polishing cloth, the grinding under the first condition and that under the second condition may be sequentially performed by moving the substrate between different polishing cloths or between different regions of the same polishing cloth.

According to the present invention, high polishing speed and superior planarity may be achieved simultaneously, so that polishing with superior planarity may be achieved in a shorter time.

Thus the application of the present invention to, for example, planarization in the production process of the semiconductor apparatus, leads to manufacture of high reliability devices for multi-layer interconnection structures with an excellent throughput.

DESCRIPTION OF THE PREFERRED EMBODIMENTS

Figure 1:
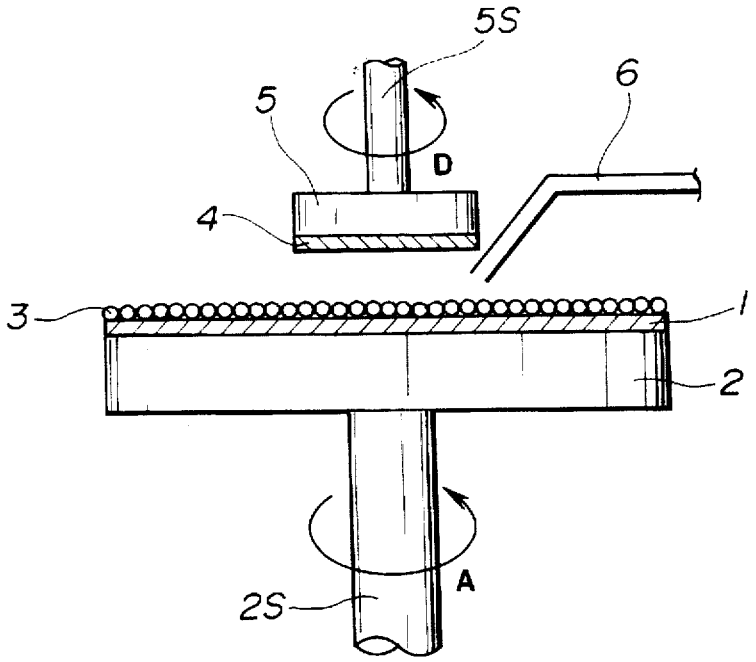
FIG.1 (RELATED ART)
FIG. 1 is a schematic side view showing a polishing apparatus according to the related art.

Referring to the drawings, illustrative embodiments of the polishing method and apparatus according to the present invention will be explained in detail.

In a first embodiment of the polishing method of the present invention, polishing is carried out until partway under the first condition of maintaining surface roughness of the polishing cloth so as to be substantially constant and equal to surface roughness that prevailed prior to start of polishing, and the remaining portion of polishing is carried out subsequently under the second condition of gradually decreasing the surface roughness.

Figure 2:
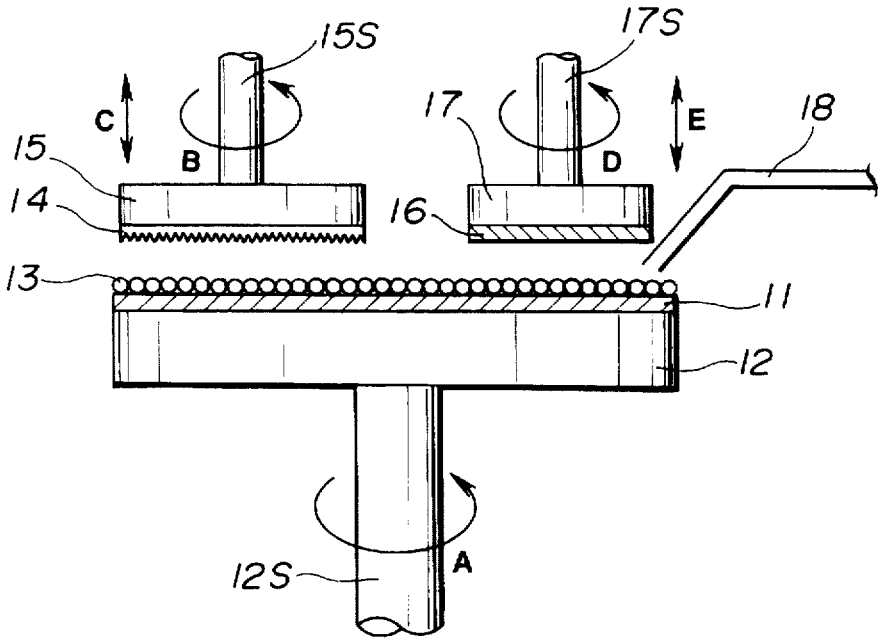
FIG. 2 is a schematic side view showing a polishing apparatus according to a first embodiment of a polishing apparatus of the present invention.
Figure 3:
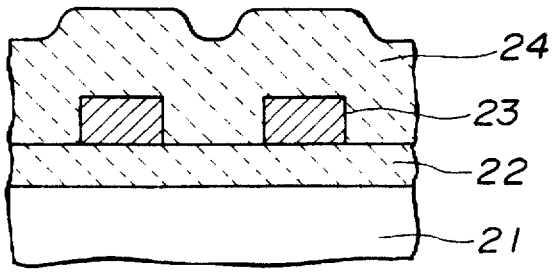
FIG. 3 shows the process for planarizing an interlayer insulating film in accordance with the present invention, and specifically showing the state of a substrate in which the interlayer insulating film covering the interconnection pattern has been formed.

An illustrative construction of the polishing apparatus is explained by referring to the side view of FIG. 2.

The polishing apparatus has a rotary table 12 has a rotary table 12, having a polishing cloth 11 with a surface roughness with mean roughness of 7 μm, applied taut thereon, and means 18 for supplying a slurried polishing agent 13 to the polishing cloth 1. The polishing apparatus also has a rotary grinding head 15 having grinding abrasive grains 14 of diamond with a particle size of 100 μm embedded therein and adapted for being slidingly contacted with the polishing cloth 11, and a substrate holder 17 for tightly holding a substrate 16 for bringing the substrate 16 into sliding contact with the polishing cloth 11.

The rotary table 12 may be rotated in a direction shown by arrow A in FIG. 2 by having its center shaft 12S coupled to an output shaft of an electric motor, not shown.

The rotary grinding head 15 also has its center shaft 15S connected to an output shaft of a driving mechanism, not shown, whereby the grinding head may be rotated at a desired rpm in a direction shown by arrow B in FIG. 2. In addition, the rotary grinding head 15 may be moved in a direction shown by arrow C in FIG. 2 for controlling sliding contact and separation as well as thrusting pressure of the grinding abrasive grains 14 with respect to the polishing cloth 11.

The rotary grinding head 15 has its center shaft 17S coupled to a driving shaft, not shown, so that the substrate 16 may be rotated in a direction shown by arrow D in FIG. 2, while it may be moved in a direction shown by arrow E in FIG. 2, for controlling the sliding contact and separation of the substrate 16 with respect to the polishing cloth 11.

With the use of the polishing apparatus, the grinding abrasive grains 14 of the rotary grinding head 15 are brought into sliding contact with the polishing cloth 11, at the same time as the surface of the substrate 16 to be polished is brought into sliding contact with the polishing cloth 11, as the substrate 16 is held on the substrate holder 17, by way of performing simultaneous grinding, whereby the substrate 16 may be polished under the first condition, namely the condition in which the surface roughness of the polishing surface 11 is maintained so as to be substantially equal to surface roughness that prevailed prior to start of polishing. On the other hand, by bringing the surface of the substrate 16 to be polished into sliding contact with the polishing cloth 11 while the grinding abrasive grains 14 of the rotary grinding head 15 are spaced apart from the polishing cloth 11, the substrate 16 may be polished continuously under the second conditions, namely the condition in which the surface roughness of the polishing cloth 11 is decreased gradually.

An example in which an interlayer planarizing film is formed during the production process for the semiconductor device, using the above-described polishing apparatus, is now explained.

First, a wafer (substrate) 16, having a lower insulating film 22 of silicon oxide, an interconnection pattern 23 of an Al-based material and an interlayer insulating film 24 covering the interconnection pattern 23,o n a silicon substrate 21, was prepared. The interlayer insulating film 24 was formed under the film-forming conditions comprising the flow rate of a starting gas tetraoxysilane (TEOS) of 350 sccm, flow rate of oxygen ($O_2$ ) of 350 sccm, pressure of 1330 Pa (10 Torr), temperature of 400° C. and the RF power of 360 W.

The substrate 16, designed as described above, was polished as described below for removing protrusions of the step differences of the interlayer insulating film 24.

Specifically, the substrate 16 was held on the substrate holder 17 so that the interlayer insulating film 24 faces the polishing cloth 11. The substrate 16 was rotated at a 17 rpm, while the rotary table 12 was rotated at 37 rpm, at the same time as a slurried polishing agent 13 consisting of silica/potassium hydroxide/water was supplied to the polishing cloth 11. The surface of the rotary grinding head 15 carrying the grinding abrasive grains 14 was brought into sliding contact with the polishing cloth 11 under a thrusting pressure of 30 kgf as the holding surface was rotated at 50 rpm. The substrate 16 was brought into sliding contact with the polishing cloth 11 which is simultaneously ground by the rotary grinding head 15. By such simultaneous grinding, the substrate 16 was ground under the first condition, that is the condition under which the surface roughness of the polishing cloth 11 was maintained at a mean roughness of 7 μm.

Figure 4:
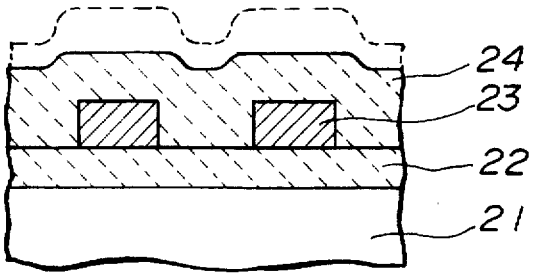
FIG. 4 is a schematic cross-sectional view showing the state in which polishing has proceeded partway on the substrate of FIG. 3.
Figure 5:
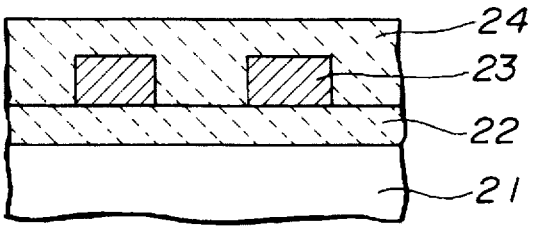
FIG. 5 is a schematic cross-sectional view showing the state in which polishing has proceeded to the final stage on the substrate of FIG. 4.

Then, as shown in FIG. 4, approximately 90% of a design amount of elimination of the interlayer insulating film 24 of the substrate 16 is removed for reducing the surface step difference s of the substrate 16 to 300 nm. The polishing operation was continued under the same conditions except that the grinding abrasive grains 14 on the rotary grinding head 15 were separated away from the polishing cloth 11 for terminating the grinding. Thus the remaining portion of the polishing operations for the substrate 16 was carried out under the second conditions in which surface roughness of the polishing cloth 11 was gradually decreased, until the interlayer insulating film 24 was planarized such that the surface step difference on the substrate 16 reached 100 nm.

After termination of the polishing on the surface of the substrate 16 to be polished, the substrate 16 was separated away from the polishing cloth 11 and rinsed with an aqueous solution of hydrogen fluoride (HF) for removing the polishing agent 13 affixed to the substrate surface to be polished.

The polishing cloth 11 was again ground using the rotary grinding head 15 for recovering surface roughness of the polishing cloth 11 which prevailed prior to the polishing. Thus enables the polishing cloth to be used in a similar manner for polishing the next substrate.

Figure 6:
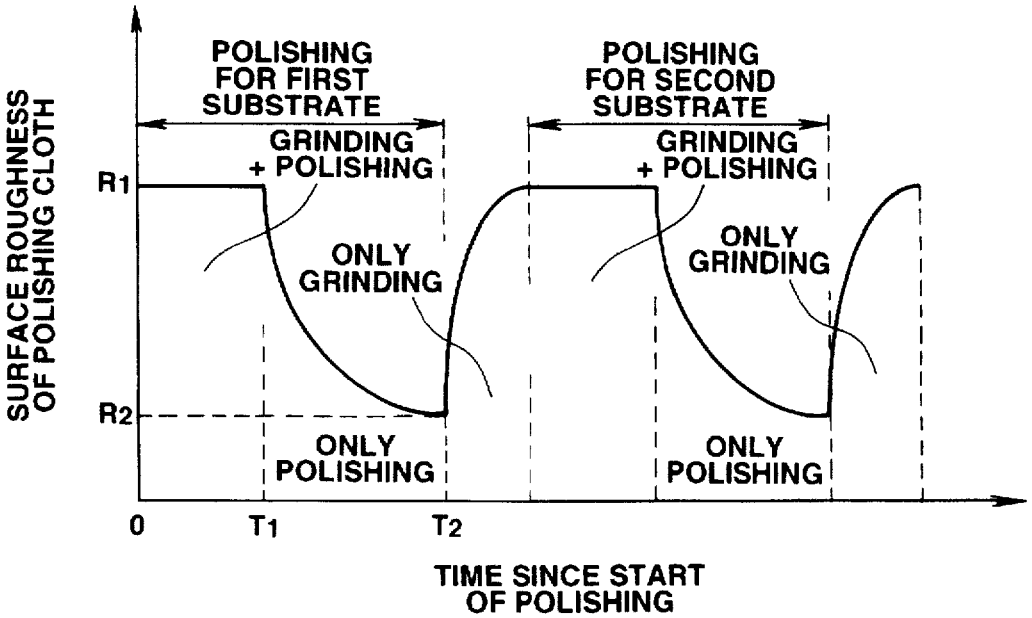
FIG. 6 is a timing chart showing changes in surface roughness of the polishing cloth during polishing under application of an illustrative polishing method according to the present invention.

Specifically, the planarity of the substrate surface is changed as shown in FIG. 6, that is so that it is maintained at $R_1$ when grinding is performed simultaneously, that is during time 0 to T, since the start of polishing. The planarity is then lowered to $R_2$ when polishing is carried out and grinding is discontinued during time $T_1$ to $T_2$ since the start of polishing. The planarity is restored to $R_1$ by carrying out only grinding after termination of polishing. It is noted that $R_1$ and $R_2$ denote mean roughness of 7 μm and 4 μm, respectively.

Figure 7:
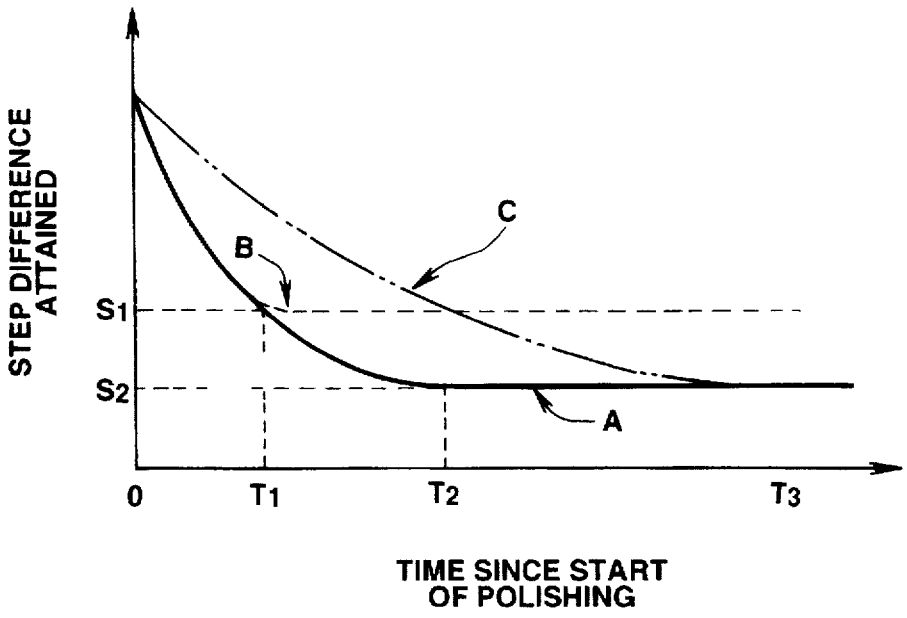
FIG. 7 is a timing chart showing changes in planarity in polishing achieved during polishing under application of an illustrative polishing method according to the present invention.

On the other hand, the planarity of the substrate surface thus achieved is changed as shown by a curve A in FIG. 7, in which changes in planarity with lapse of time in case polishing is carried out until the end of polishing under the first condition, that is under the condition in which surface roughness of the polishing cloth 11 is maintained at the mean roughness of 7 μm as a result of simultaneous grinding and those in case polishing is carried out from the outset under the second condition in which surface roughness of the polishing cloth is allowed to be lowered, are shown by curves B and C, respectively. In FIG. 7, planarity is lowered in an upward direction along the ordinate.

Referring to FIG. 7, planarity (step difference) of $S_1$ is achieved in time $T_1$ since the start of polishing, if polishing is continued until its end under the first condition (curve B). However, in this case, planarity (step difference) cannot be improved further on sustained polishing. If polishing is carried out under the second condition from the outset (curve C), the planarity (step difference) of $S_2$ is achieved only after a prolonged time equal to $T_3$. On the other hand, if polishing is carried out by the polishing method of the present invention (curve A), in which polishing is first carried out under the first condition until planarity (step difference) of $S_1$ is achieved in a short time of $T_1$ and polishing is then carried out under the second condition, the planarity of $S_2$ may be achieved at time $T_2$ since the start of grinding. Meanwhile, $S_1$ and $S_2$ denote surface roughness of 300 nm and 100 nm, respectively.

The second embodiment of the present invention is now explained.

The polishing apparatus of the present embodiment is configured so that polishing is carried out until partway under the first condition in which surface roughness of the polishing cloth is maintained at a larger constant value and the remaining portion of polishing is carried out under the second condition in which surface roughness is maintained at a smaller constant value. With the present polishing apparatus, the first condition may be generated by carrying out grinding under a pre-set condition on a polishing cloth applied taut on a rotating table, while the second condition may be generated by carrying out grinding under a different condition on a different polishing cloth applied taut on a different rotating table.

Figure 8:
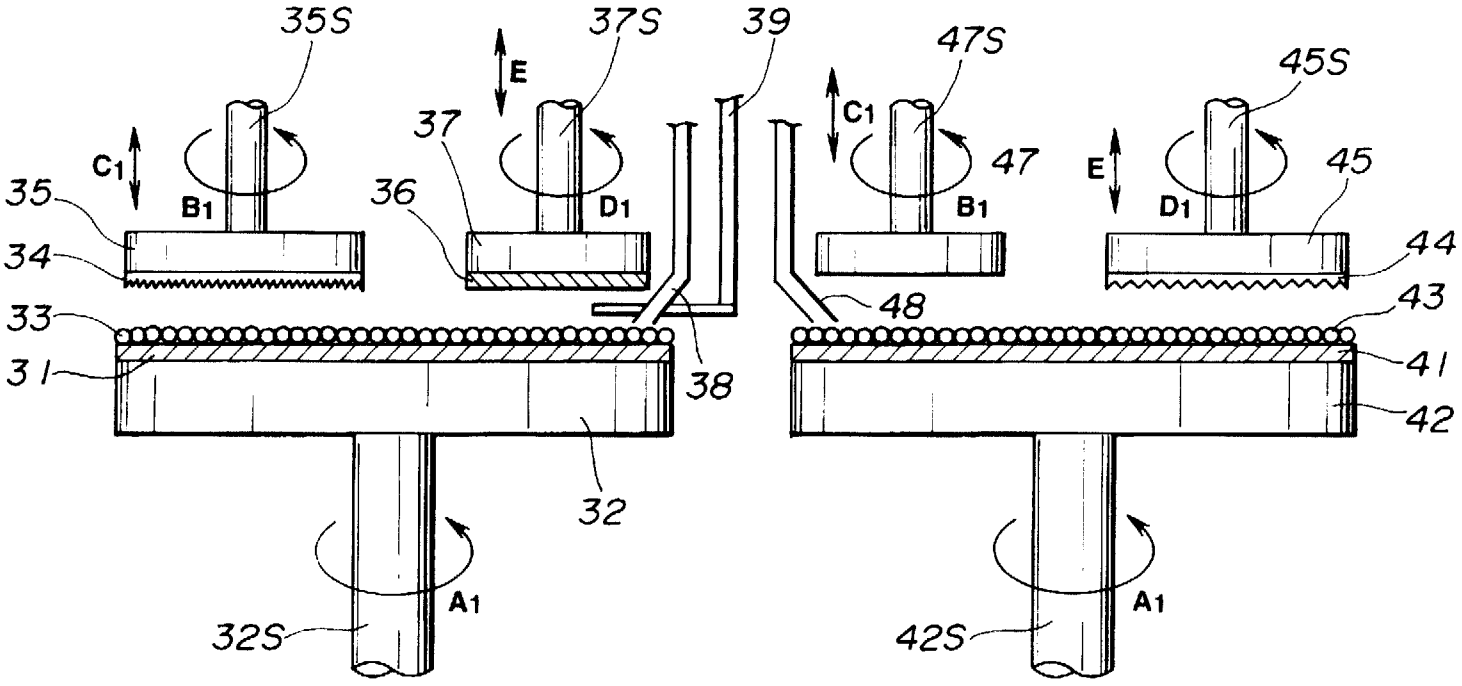
FIG. 8 is a schematic side view showing a polishing apparatus according to a second embodiment of a polishing apparatus of the present invention.

Referring to the side view of FIG. 8, the polishing apparatus includes a first rotary table 32 and a second rotary table 42, on which a first polishing cloth 31 having a mean roughness equal to 8 μm and a second polishing cloth 31 having a mean roughness equal to 3 μm are applied taut, respectively. The polishing apparatus also includes a first polishing agent supplying means 38 and a second polishing agent supplying means 28 for supplying slurried polishing agents 33, 43 to the polishing cloths 31, 41, respectively. The polishing apparatus also includes a first rotating grinding head 35 and a second grinding rotary head 45 adapted for being brought into sliding contact with the polishing cloths 31, 41, respectively, provided for the rotary tables 32, 42, respectively, and a first substrate holder 37 and a second substrate holder 47 tightly carrying a substrate 36 for bringing the substrate 16 into sliding contact with the polishing cloths 31, 41, respectively. In addition, the polishing apparatus includes a handler (movement means) for moving the substrate 36 between the substrate holders 37 and 47.

In the above grinding apparatus, the first rotary table 32 and the second rotary table 42 are connected by center shafts 32S, 42S thereof coupled to output shafts of electric motors, not shown, for being rotated in a direction indicated by arrow $A_1$ in FIG. 8.

The first rotary grinding head 35 holds grinding abrasive grains 34 of diamond, with the grain size of 100 μm, on its slide contact surface with the first polishing cloth 31, while the second rotary grinding head 45 holds grinding abrasive grains 44 of diamond, with the grain size of 30 μm, on its slide contact surface with the second polishing cloth 41, for providing the polishing cloths 31, 41 with surface roughnesses different from each other. The rotary grinding heads 35, 45 are connected by center shafts 35S, 45S thereof to a driving mechanism, not shown, whereby the rotary grinding heads 35, 45 may be rotated with respective desired rpms in a direction shown by arrow B in FIG. 8. The rotary grinding heads 35, 45 may also be moved in a direction shown by arrow C in FIG. 8 for controlling the sliding contact/separation as well as thrusting pressure with respect to the first polishing cloth 31 and the second polishing cloth 41, respectively.

The first substrate holder 37 and the second substrate holder 47 are also connected by center shafts 37S, 47S thereof to a driving mechanism, not shown, respectively, whereby the substrate 36 may be rotated in a direction shown by arrow D in FIG. 8. In addition, the first substrate holder 37 and the second substrate holder 47 may also be moved in a direction shown by arrow E in FIG. 8 for controlling the sliding contact/separation as well as thrusting pressure with respect to the first polishing cloth 31 and the second polishing cloth 41, respectively.

The handler 39 is capable of supporting the peripheral portion of the substrate 36 and moving the substrate 36 in a pre-set direction by a driving mechanism, not shown. This enables the substrate 36 held on the first substrate holder 37 to be transferred to the second substrate holder 47.

With the above-described construction of the polishing apparatus, by setting the grinding conditions for the first polishing cloth 31 by the first rotary grinding head 35 so as to be different from those for the second polishing cloth 41 by the second rotary grinding head 45, the polishing operation for the substrate 36 under the first condition, that is the condition in which surface roughness of the first polishing cloth 31 is maintained at a constant higher value, and the polishing operation for the substrate 36 under the second condition, that is the condition in which surface roughness of the second polishing cloth 41 is maintained at a constant lower value, may be carried out sequentially.

The third embodiment of the present invention is now explained.

The polishing operation employing the polishing apparatus shown in the third embodiment was carried out as follows:

The first rotary table 32 was rotated at 37 rpm. A slurried polishing agent 33, consisting of silica/potassium hydroxide/water, was supplied to the first polishing cloth 31, while the grinding abrasive grains 34 of the first rotary grinding head 31 were brought into sliding contact with the first polishing cloth 31 for carrying out grinding under the grinding conditions comprising the grain size of 100 μm, number of revolutions (rpm) of 50 and the thrusting pressure of 30 kgf.

The grinding abrasive grains 34 were of diamond, as in the second embodiment.

The substrate 36 having the same construction as that of the first embodiment was held on the first substrate holder 37 and rotated at 17 rpm, at the same time as the substrate 36 was brought into sliding contact with the first polishing cloth 31. In this manner, the grinding of the substrate 36 by the first polishing cloth 31 maintained at a mean surface roughness of 8 μm (grinding under the first condition) was carried out.

Then, approximately 90% of a design amount of elimination of the substrate 36 was removed for reducing the surface step difference of the substrate 36 to 300 nm. The first substrate holder 37 was then separated from the first polishing cloth 31 and the substrate 36 was moved by the handler 39 so as to be held on the second substrate holder 47. Similarly to the first rotary table 32, the second rotary table 42 was rotated at this time . and the polishing agent 43 similar to the polishing agent 33 was supplied to the second polishing cloth 41. The grinding abrasive grains 44 of the second rotary grinding head 45 were brought into sliding contact with the second polishing cloth 41 for carrying out grinding under the grinding conditions comprising the grain size of the grinding abrasive grains of 30 μm, the number of revolutions (rpm) of 50 and the thrusting pressure of 30 kgf. The grinding abrasive grains 34 employed were of diamond, as in the second embodiment described above.

The substrate 36 was brought into siding contact with the second polishing cloth 41 in this state, as the substrate 36 was rotated at 17 rpm, for carrying out the remaining portion of the grinding operation. In this manner, the substrate 36 was polished by the second polishing cloth 41 maintained at a mean surface roughness of 3 μm, by way of performing polishing under the second condition, until the surface step difference was decreased to 100 nm.

Figure 9:
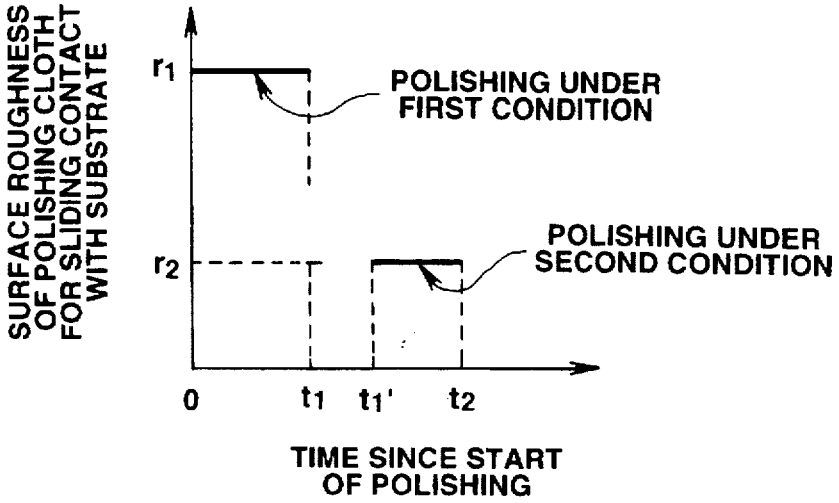
FIG. 9 is a timing chart showing changes in surface roughness of the polishing cloth during polishing under application of second to fifth embodiments of the polishing method according to the present invention.

In the polishing method of the instant embodiment, the surface roughness of the polishing cloth, brought into sliding contact with the substrate 36, was varied as shown in FIG. 9. Specifically, the surface roughness was maintained at r1 and r2 during polishing under the first condition, that is during time 0 till t1 since start of the polishing, and during polishing under the second condition, that is during time t1' till t2 since start of the polishing, respectively. During the time t1 till t1' since the start of the grinding, the substrate 16 is being moved from a position on the first polishing cloth 31 to a position on the second polishing cloth 41. It is noted that r1 and r2 denote a mean roughness of 8 μm and a surface roughness of 3 μm, respectively.

Figure 10:
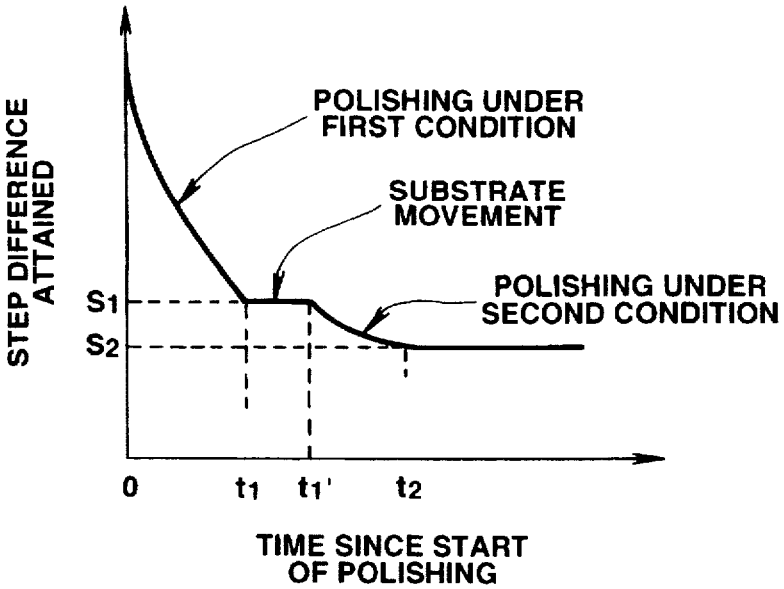
FIG. 10 is a timing chart showing changes in planarity in polishing achieved during polishing under application of another illustrative polishing method according to the present invention.

The surface planarity of the substrate 36, achieved by the polishing method of the instant embodiment, is varied as shown in FIG. 10. That is, after the planarity (step difference) of s1 is achieved at time t1 since the start of polishing by the polishing under the first condition, the planarity (step difference) may be improved to s2 at time t2 since the start of polishing by the polishing under the second condition. Meanwhile, s1 and s2 denote surface step differences equal to 300 nm and 100 nm, respectively.

With the polishing method of the instant embodiment, since the time for recovery of the surface roughness is not required for any of the first polishing cloth 31 nor the second polishing cloth 41, grinding of the next substrate by the first polishing cloth 31 may be started during grinding of the substrate 36 by the second polishing cloth 41 after the end of the polishing of the substrate 36 by the first polishing cloth 31.

The fourth embodiment of the present invention is now explained.

With the polishing apparatus of the instant embodiment, a first condition in which the relative roughness of the polishing cloth is maintained at a higher constant value is generated by carrying out grinding under a pre-set condition at a pre-set position of a polishing cloth applied taut on a sole rotary plate, while a second condition in which the relative roughness of the polishing cloth is maintained at a lower constant value is generated by carrying out polishing under a pre-set condition at another pre-set position of the same polishing cloth.

Figure 11:
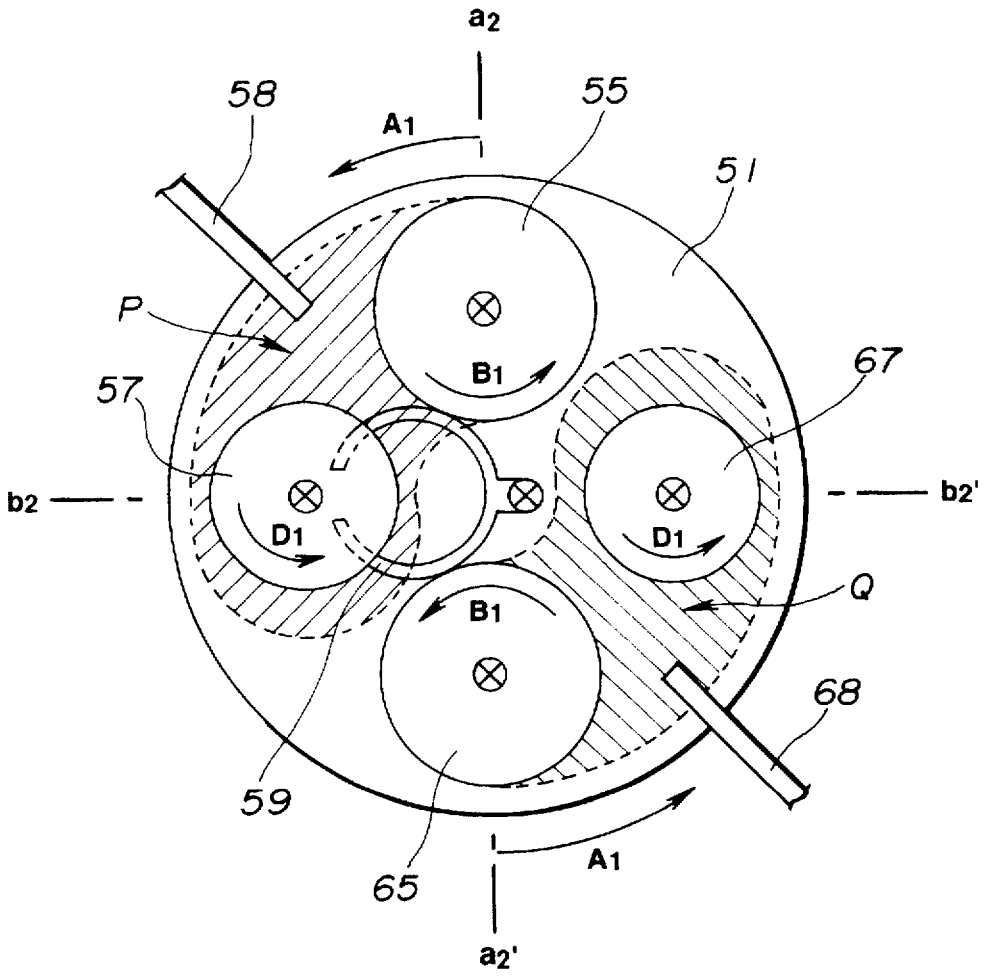
FIG. 11 is a schematic side view showing a polishing apparatus according to a third embodiment of a polishing apparatus of the present invention.
Figure 12:
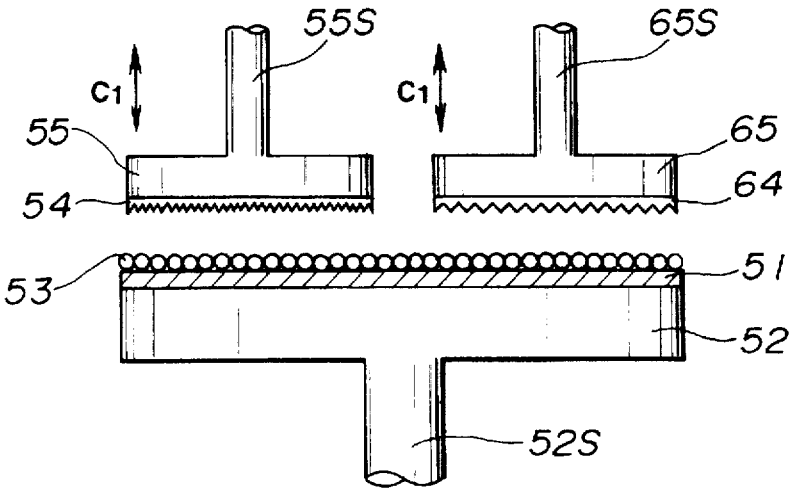
FIG. 12 is a schematic cross-sectional view showing the cross-section along line a–a' in FIG. 11.
Figure 13:
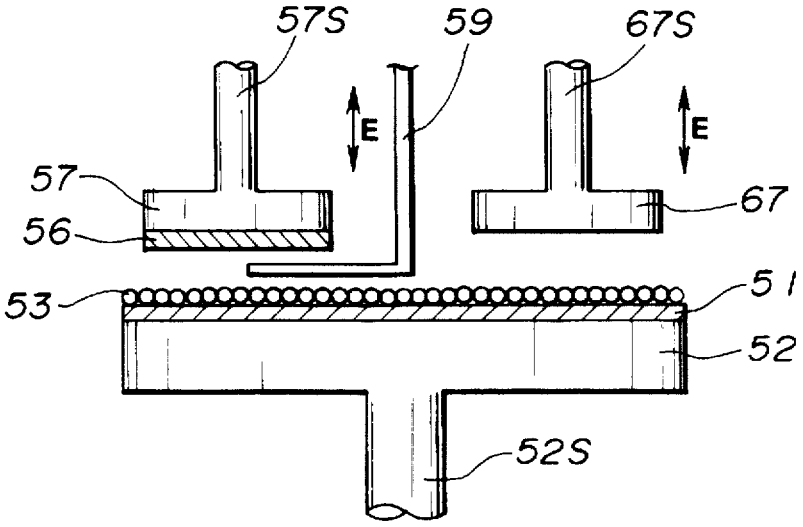
FIG. 13 is a schematic cross-sectional view showing the cross-section along line b–b' in FIG. 11.

The polishing apparatus is shown in a top plan view of FIG. 11 a cross-sectional view of FIG. 12, taken along line $a_2$–$a_{2'}$ of FIG. 11, and in a cross-sectional view of FIG. 13, taken along line $b_2$–$b_{2'}$ of FIG. 11. The polishing apparatus includes a rotary table 52, on which the polishing cloth 51 is applied taut, and means 58, 68 for supplying a slurried polishing agent 53 to the polishing cloth 51. The polishing apparatus also includes a first rotary grinding head 55 and a second rotary grinding head 65, both arranged facing the polishing cloth 51 and are adapted for being brought into sliding contact with the polishing cloth 51 for carrying out the polishing. The polishing apparatus also includes a first substrate holder 57 and a second substrate holder 67, both adapted for tightly holding the substrate 56 and for bringing the substrate into sliding contact with the polishing cloth 51. In addition, the polishing apparatus includes a handler 59 for moving the substrate 56 between the substrate holders 57 and 67.

In the above grinding apparatus, the rotary table 52 is connected by its center shaft 52S coupled to an output shaft of an electric motor, not shown, for being rotated in a direction indicated by arrow $A_1$ in FIG. 11.

The first rotary grinding head 55 holds first grinding abrasive grains 54 of diamond, with the diamond grain size of 100 μm, on its slide contact surface with the polishing cloth 51, while the second rotary grinding head 65 holds second grinding abrasive grains 64 of diamond, with the diamond grain size of 30 μm, on its slide contact surface with the polishing cloth 51, so that, when the grinding abrasive grains 54, 64 of the rotary polishing heads 55, 65 are brought into sliding contact with the polishing cloth 51, two regions P, Q of different surface roughnesses will be formed on the polishing cloth 51 downstream of the rotary grinding heads 55, 65. The first rotary grinding head 55 and the second rotary grinding head 65 are also connected by center shafts 55S, 65S thereof to a driving mechanism, not shown, respectively, whereby the first and second rotary grinding heads 55, 65 may be rotated in a direction of arrow $B_1$ in FIG. 11. In addition, the first and second rotary grinding heads may also be moved in a direction of arrow $C_1$ in FIG. 12 for controlling the sliding contact/ separation as well as thrusting pressure with respect to the polishing cloth 51.

The first substrate holder 57 and the second substrate holder 67 are provided downstream of the first rotary grinding head 55 and the second rotary grinding head 65, respectively, for bringing the substrate 56 into sliding contact with the regions P and Q on the polishing cloth 51. The first substrate holder 57 and the second substrate holder 67 are also connected by center shafts 57S, 67S thereof to a driving mechanism, not shown, respectively, whereby the substrate 56 may be rotated in a direction shown by arrow $D_1$ in FIG. 11. In addition, the first and second substrate holders 57, 67 may also be moved in a direction of arrow E in FIG. 13 for controlling the sliding contact/separation as well as thrusting pressure with respect to the polishing cloth 51.

The handler 59 is designed for supporting the peripheral portions of the substrate 56 and for moving the substrate 56 in a pre-set direction by a driving mechanism, not shown, whereby the substrate 56 held on the first substrate holder 57 may be transferred to the second substrate holder 57.

With the above-described construction of the polishing apparatus, by setting the grinding conditions for the polishing cloth 51 by the first rotary grinding head 55 so as to be different from those by the second rotary grinding head 65, the polishing operation for the substrate 56 in the region P of the polishing cloth 51 where its surface roughness is maintained at a higher constant level, that is the polishing operation under the first condition, and the polishing operation for the substrate 56 in the region Q of the polishing cloth 51 where its surface roughness is maintained at a lower constant level, that is the polishing operation under the second condition, may be carried out sequentially.

The fifth embodiment of the present invention is now explained.

The polishing operation by the polishing apparatus shown in the fourth embodiment was carried out as follows:

The rotary table 32 was rotated at 37 rpm and a slurried polishing agent 53 consisting of silica/potassium hydroxide/water was supplied from the polishing agent supply means 58, 68 to the polishing cloth 51. The first grinding abrasive grains 54 of the first rotary grinding head 55 and the second grinding abrasive grains 64 of the second rotary grinding head 65 were brought into sliding contact with the polishing cloth 51 and grinding was carried out under the grinding conditions for the first rotary grinding head 55 comprising the grain diameter of the grinding abrasive grains of 100 μm, the number of revolutions (rpm) of 50 and the thrusting pressure of 30 kgf, and under the grinding conditions for the second rotary grinding head 65 comprising the grain diameter of the grinding abrasive grains of 30 μm, the number of revolutions (rpm) of 50 and the thrusting pressure of 30 kgf. The grinding abrasive grains of diamond were used for the grinding abrasive grains 54, 64, as in the fourth embodiment described above.

By the above grinding operations, the region P having a mean surface roughness of 7.5 μm and the region Q having a mean surface roughness of 2.5 μm were formed on the polishing cloth 51 downstream of the first rotary grinding head 55 and downstream of the second rotary grinding head 65, respectively.

The substrate 56, configured similarly to the first embodiment, was held on the first substrate holder 57 and rotated at 17 rpm. The substrate 56, thus rotated, was brought into sliding contact with the region P of the polishing cloth 51 for polishing. In this manner, polishing under the first condition in which the mean surface roughness of the polishing cloth 51 was maintained at 7.5 μm was performed.

Then, approximately 90% of a design amount of elimination of the substrate 56 was removed for reducing the surface step differences of the substrate 56 to 300 nm. The first substrate holder 57 was then separated from the region P and the substrate 56 was transferred by the handler 59 from the first substrate holder 57 to the second substrate holder 67. The residual portion of the polishing was carried out by bringing the substrate 56 into sliding contact with the region Q on the polishing cloth 51 as the substrate 56 was kept in rotation. In this manner, the grinding was carried out under the second condition, that is under the condition in which the surface roughness of the polishing cloth 51 was maintained at a mean value of 2.5 μm.

That is, with the polishing method of the present invention, the surface roughness of the polishing cloth, brought into sliding contact with the substrate 56, was varied as shown in FIG. 9, as in the third embodiment described above. Meanwhile, r1 and r2 denote mean values of surface roughness equal to 7.5 μm and 2.5 μm, respectively.

The surface planarity of the substrate 56, achieved with the polishing method of the present invention, is also varied as shown in FIG. 10, as in the third embodiment described above. That is, by carrying out polishing under the second condition after achieving the planarity s1 by the polishing under the first condition, the value of planarity equal to s2, which is more satisfactory, may be achieved. Meanwhile, s1 and s2 denote the values of surface roughness equal to 300 nm and 100 nm, respectively.

With the polishing method of the instant embodiment, since the time for recovery of the surface roughness is not required for any of the regions P or Q of the polishing cloth 51, grinding of the next substrate by the region P may be started during grinding of the substrate 56 by the region Q after the end of the polishing of the substrate 36 by the region P.

Although preferred embodiments of the polishing method and apparatus of the present invention have been described above, the present invention is not limited to these merely illustrative embodiments. For example, although the grinding of the polishing cloth 11 was discontinued after polishing under the first condition and the surface roughness of the polishing cloth 11 was gradually lowered for carrying out the polishing under the second condition, the polishing under the second condition may also be performed as surface roughness of the polishing cloth is maintained at a smaller constant value by carrying out grinding under different conditions. This may be achieved by diminishing the thrusting pressure against the polishing cloth 11 or the rpm of the rotary grinding head 15 during polishing. For example, it suffices if the thrusting pressure against the polishing cloth 11, which is 30 kgf during polishing under the first condition, is changed to 5 kgf during polishing under the second condition.

Although the grain diameters of the grinding abrasive grains embedded in the two rotary grinding heads in the polishing apparatus of the second and fourth embodiments are selected to be different from each other, different values of surface roughness may be accorded to the polishing cloth by selecting the rpm of the rotary grinding head or the thrusting pressure applied to the polishing cloth to different values even if the hardness or the grain diameter of the grinding abrasive grains remain the same for the two heads. Although the handler is provided in the polishing apparatus of the second and fourth embodiments, the sole substrate holder may be adapted for being moved between different polishing cloths or between different regions of the same polishing cloth while the substrate is held on the sole substrate.

In addition, although the polishing under the first condition and the polishing under the second condition have been modified by using different values of the grain diameter of the grinding abrasive grains used for grinding the polishing cloth, the polishing under the first condition and the polishing under the second condition may also be modified by diminishing the rpm or the thrusting pressure against he polishing cloth. For example, as for the polishing under the second condition, the thrusting pressure of the rotary grinding may be modified from 30 kgf to 5 kgf, with the grain diameter of the grinding abrasive grains being of the same value of 100 μm.

Furthermore, although the surface roughness of the polishing cloth is varied only once in the polishing method of the third and fifth embodiments, the surface roughness of the polishing cloth may also be changed twice or more for improving planarity step-by-step. However, for achieving this, a separate rotary table is required for the polishing apparatus of FIG. 8 along with the associated rotary table, rotary grinding head and the substrate holder. With the polishing apparatus of FIG. 11, separate rotary grinding head is required for the sole rotary table.

The present invention is applicable not only to planarization of the interlayer insulating film, but also to elimination of the portions other than the inner portion of the groove in the buried insulating film formed on the grooved semiconductor substrate. The present invention is also applicable to formation of a silicon active layer employing a bonded silicon-on-insulator (SOI).

What is claimed is:

1. A polishing method for polishing a substrate by bringing a surface of said substrate to be polished into rotating contact with a polishing cloth extended taut on a rotary table as a polishing agent is supplied to said polishing cloth, comprising:

rotating the rotary table;

rotating the substrate;

rotating a first grinding head carrying first abrasive particles on a surface thereof;

carrying out said polishing under a first condition in which the surface roughness of said polishing cloth is maintained at a constant larger value by simultaneously engaging the first abrasive particles disposed on the rotating first grinding head with the polishing cloth disposed on the rotating rotary table and grinding the polishing cloth with the first abrasive particles under predetermined thrusting pressure and rotational velocity of the first grinding head;

subsequently carrying out the remaining portion of the polishing in continuation to said polishing under said first condition under a second condition in which the surface roughness is maintained at a smaller constant value by varying the thrusting pressure and rotational velocity of the first grinding head.

2. The polishing method as claimed in claim 1 wherein said first condition is generated by grinding the polishing cloth with the first grinding head at a pre-set location on the polishing cloth applied taut on a sole rotary plate, and wherein said second condition is generated by carrying out the grinding under different conditions at another pre-set location for the same polishing cloth.

3. The polishing method as claimed in claim 2 wherein the grinding for said polishing cloth is carried out by bringing the first grinding head into rotating contact with the polishing cloth under pre-set conditions as the surface of said first rotary grinding head carrying first abrasive particles is rotated, and wherein the grinding under the different conditions is carried out using at least one of the thrusting pressure and number of revolutions of said first grinding head which is lower than that for the grinding under said pre-set conditions.

4. A polishing method for polishing a substrate by bringing a surface of said substrate to be polished into rotating contact with a polishing cloth extended taut on a rotary table as a polishing agent is supplied to said polishing cloth, comprising:

rotating the rotary table;

rotating the substrate:

rotating a first grinding head carrying first abrasive particles on a surface thereof;

carrying out said polishing under a first condition in which the surface roughness of said polishing cloth is maintained at a constant larger value by simultaneously engaging the first abrasive particles disposed on the rotating first grinding head with the polishing cloth disposed on the rotating rotary table;

disengaging the first grinding head from the polishing cloth;

rotating a second grinding head carrying second abrasive particles on a surface thereof;

carrying out said polishing under a second condition in which the surface roughness of said polishing cloth is maintained at a different value by engaging the second rotating grinding head with the polishing cloth, so that the second abrasive particles engage the polishing cloth, the second abrasive particles having a second particle diameter that is smaller than a particle diameter of the first abrasive particles so that the second grinding head imparts a different surface roughness to the polishing cloth than the first grinding head.

5. The polishing method as claimed in claim 4 wherein said first condition is generated by grinding the polishing cloth with the first grinding head at a pre-set location on the polishing cloth applied taut on a sole rotary plate, and wherein said second condition is generated by carrying out the grinding under different conditions at another pre-set location for the same polishing cloth.

6. The polishing method as claimed in claim 4 wherein the grinding for said polishing cloth is carried out by bringing the first grinding head into rotating contact with the polishing cloth under pre-set conditions as the surface of said first rotary grinding head carrying first abrasive particles is rotated, and wherein the grinding under the different conditions is carried out using at least one of the thrusting pressure and number of revolutions of said first grinding head which is lower than that for the grinding under said pre-set conditions.

* * * * *